US011953240B2

(12) United States Patent
Raimbault et al.

(10) Patent No.: US 11,953,240 B2
(45) Date of Patent: Apr. 9, 2024

(54) REVERSIBLE HEAT PUMP

(71) Applicant: TRANE INTERNATIONAL INC., Davidson, NC (US)

(72) Inventors: Yves Jacques Raimbault, Uxegney (FR); Qingnan Huang, Shanghai (CN)

(73) Assignee: TRANE INTERNATIONAL INC., Davidson, NC (US)

( * ) Notice: Subject to any disclaimer, the term of this patent is extended or adjusted under 35 U.S.C. 154(b) by 43 days.

(21) Appl. No.: 17/668,109

(22) Filed: Feb. 9, 2022

(65) Prior Publication Data

US 2022/0268496 A1 Aug. 25, 2022

(30) Foreign Application Priority Data

Feb. 9, 2021 (CN) ..... 202110176540.5

(51) Int. Cl.

| | |
|---|---|
| ***F25B 30/02*** | (2006.01) |
| ***F25B 13/00*** | (2006.01) |
| ***F25B 29/00*** | (2006.01) |
| ***F25B 40/06*** | (2006.01) |

(52) U.S. Cl.

CPC ..... *F25B 30/02* (2013.01); *F25B 13/00* (2013.01); *F25B 29/003* (2013.01); *F25B 40/06* (2013.01); *F25B 2313/02731* (2013.01); *F25B 2700/21152* (2013.01)

(58) Field of Classification Search

CPC ..... F25B 30/02; F25B 13/00; F25B 29/003; F25B 40/06; F25B 2313/02731; F25B 2313/003; F25B 2313/0272; F25B 2700/21152; F25B 2400/04; F25B 2600/2501; F25B 2700/21151; F25B 2700/21175; F25B 40/00; F25B 41/20; F25B 49/02; F25B 41/40

See application file for complete search history.

(56) References Cited

U.S. PATENT DOCUMENTS 5,634,352 A * 6/1997 Nagai ..... F25B 13/00 62/278

FOREIGN PATENT DOCUMENTS

| | | | | |
|---|---|---|---|---|
| CN | 102147126 A | * | 8/2011 | ..... F24F 3/065 |
| CN | 109631381 A | * | 4/2019 | |
| CN | 110645731 A | * | 1/2020 | |
| CN | 111256395 A | * | 6/2020 | |
| CN | 112303944 A | | 2/2021 | |
| EP | 1873466 A2 | | 1/2008 | |
| EP | 3779328 A1 | | 2/2021 | |

(Continued)

OTHER PUBLICATIONS

Extended European Search Report; European Patent Application No. 22155784.6, dated Jun. 24, 2022 (7 pages).

*Primary Examiner* — Kun Kai Ma

(74) *Attorney, Agent, or Firm* — Hamre, Schumann, Mueller & Larson, P.C.

(57) ABSTRACT

There is disclosed a reversible heat pump system 100 and a method of operating a reversible heat pump system to control the temperature of a process fluid of a chiller system 500. In a cooling mode, a working fluid is circulated for co-current flow with a process fluid at a heat exchanger 104 functioning as an evaporator heat exchanger, whereas in a heating mode, the working fluid is circulated for counter-current flow with the process fluid at the same heat exchanger 104 functioning as a condenser heat exchanger.

10 Claims, 6 Drawing Sheets

(56) References Cited

FOREIGN PATENT DOCUMENTS

| | | | | |
|---|---|---|---|---|
| WO | WO-2010054498 A1 * | 5/2010 | ..... | F25B 13/00 |
| WO | 2011/105270 A1 | 9/2011 | | |
| WO | WO-2018054052 A1 * | 3/2018 | ..... | F25B 1/005 |

* cited by examiner

REVERSIBLE HEAT PUMP

FIELD OF THE INVENTION

The invention relates to a reversible heat pump for use with a chiller system, in particular to heat and/or cool a process fluid of a chiller system, such as water.

BACKGROUND OF THE INVENTION

It is known to use chiller systems to provide cooling and/or heating at multiple locations through a building or installation by heat transfer between a process fluid of the chiller system and the environment of the building or installation.

Chiller systems are typically used for comfort cooling and for heating. The process fluid of the chiller system can be cooled or heated by a heat pump. For example, a heat pump may transfer heat between the process fluid and external ambient air (i.e. external to the environment of the building or installation which is to be heated or cooled).

Working fluid of a heat pump is capable of cooling the process fluid to a target temperature if it is provided to an evaporator of the heat pump at a sufficient approach temperature. The approach temperature is the temperature difference between the working fluid provided to the evaporator and the discharge temperature of the process fluid. For comfort cooling applications, a typical temperature to which the process fluid is cooled is approximately 5° C. Accordingly, when the process fluid is water there may be a freezing risk at the evaporator, considering the approach between the working fluid and the process fluid. Heat pump configurations for chiller systems are selected to reduce that risk.

STATEMENTS OF INVENTION

According to a first aspect there is disclosed a method of operating a reversible heat pump system to control the temperature of a process fluid of a chiller system, the reversible heat pump system comprising a compressor, a first heat exchanger, an expansion device, a second heat exchanger for heat exchange with the process fluid of the chiller system, and a suction line economiser heat exchanger;

the method comprising:

a controller determining whether to operate the reversible heat pump system in a cooling mode to cool the process fluid, or in a heating mode to heat the process fluid;

when in the cooling mode, circulating a working fluid through the reversible heat pump system so that compressed working fluid from the compressor rejects heat at the first heat exchanger to provide condensed working fluid to a liquid line, and so that expanded working fluid from the expansion device receives heat from the process fluid at the second heat exchanger to provide superheated working fluid along a suction line to the compressor;

when in the heating mode, circulating the working fluid through the reversible heat pump system so that compressed working fluid from the compressor rejects heat to the process fluid at the second heat exchanger to provide condensed working fluid to the liquid line, and so that the expanded working fluid from the expansion device receives heat at the first heat exchanger to provide downstream superheated working fluid along the suction line to the compressor;

wherein the process fluid is provided to the second heat exchanger for counterflow with the working fluid in the heating mode, and for co-current flow with the working fluid in the cooling mode; and wherein in each of the cooling mode and the heating mode, condensed working fluid upstream of the expansion device transfers heat to superheated working fluid upstream of the compressor, at the suction line economiser heat exchanger.

An expansion device may be, for example, a control valve (such as an electronic control valve, also known as an electronic expansion valve (EEV or EXV)).

The method may further comprise controlling the expansion device to maintain a thermodynamic condition of the working fluid at a target location along the suction line.

The method may further comprise monitoring one or more parameters relating to (i) a temperature of the working fluid at a location along the suction line and/or (ii) a pressure of the working fluid at a location along the suction line. The expansion device may be controlled to maintain a target superheat of the working fluid at a target location along the suction line.

The method may further comprise controlling a modulation device disposed along the liquid line upstream of the expansion device, to maintain a target change of temperature of the expanded working fluid through the suction line heat exchanger; and/or to maintain a target superheat of the working fluid at a target location along the suction line.

The method may further comprise monitoring temperature parameters relating to (i) a temperature of the working fluid in the suction line upstream of the suction line economiser and (ii) a temperature of the working fluid in the suction line downstream of the suction line economiser. The modulation device may be controlled to maintain the target change of temperature based on the monitored temperature parameters.

The modulation device may comprise a valve arrangement (for example a three-way valve) in the liquid line for variably distributing a flow of condensed working fluid between a first liquid line branch to the suction line economiser heat exchanger and a second liquid line branch that bypasses the suction line economiser heat exchanger. Controlling the modulation device may comprise varying a distribution of the flow between the first and second liquid line branches.

The expansion device and the modulation device may be controlled so that the working fluid is maintained at superheated conditions in the suction line, with a target superheat of at least a first superheat upstream of the suction line economiser heat exchanger, and with a target superheat of at least a second greater superheat downstream of the suction line economiser heat exchanger.

The method may further comprise determining a saturation temperature parameter corresponding to a saturation temperature of the working fluid in the suction line. The control to maintain the or each target superheat may be at least partly based on the saturation temperature parameter.

The saturation temperature parameter may be determined by: monitoring a pressure parameter relating to the pressure of the working fluid in the suction line; and evaluating a relationship between the pressure parameter and the saturation temperature parameter which is a function of the type of the working fluid.

The process fluid may comprise water and a coolant such as glycol, ethylene glycol, propylene glycol, calcium chloride, methanol, ethanol. The process fluid may comprise substantially 100% water (i.e. without an added coolant).

With such a process fluid, the controller may operate the reversible heat pump system in the cooling configuration to maintain a target process fluid discharge temperature of between 5° C.-7° C., for example 7° C.:

According to a second aspect there is disclosed a reversible heat pump system for heating and cooling a process fluid of a chiller system, comprising:

a compressor, a first heat exchanger, an expansion device, a second heat exchanger for heat exchange with the process fluid of the chiller system, and a suction line economiser heat exchanger;

wherein the reversible heat pump system is operable in:

a cooling configuration in which there is a sequential flow path for a working fluid through the reversible heat pump system from the compressor through the first heat exchanger, a liquid line pathway, the expansion device, the second heat exchanger and a suction line pathway to the compressor; and a heating configuration in which there is a sequential flow path for the working fluid from the compressor through the second heat exchanger, a liquid line, the expansion device, the first heat exchanger and a suction line pathway to the compressor;

wherein the second heat exchanger has a process fluid inlet, a process fluid outlet and a process fluid pathway therebetween for heat exchange between the process fluid provided from the chiller system and the working fluid provided to the second heat exchanger;

wherein the reversible heat pump system is configured so that working fluid is provided to the second heat exchanger along the respective sequential flow path:

for counterflow with the process fluid pathway in the heating configuration; and for co-current flow with the process fluid pathway in the cooling configuration; and wherein in each of the cooling configuration and the heating configuration, the suction line economiser heat exchanger is configured to provide working fluid in the respective liquid line pathway in heat exchange communication with working fluid in the respective suction line pathway.

The controller may be configured to control the expansion device to maintain a thermodynamic condition of the working fluid at a target location along the suction line.

The reversible heat pump system may further comprise a modulation device disposed along the liquid line pathway upstream of the expansion device, and the controller may be configured to control the modulation device to maintain a target change of temperature of the working fluid through the suction line heat exchanger; and/or to maintain a target superheat of the working fluid at a target location along the suction line.

According to a third aspect there is disclosed an installation configured to heat and/or cool an environment, comprising:

a reversible heat pump system in accordance with the second aspect;

a chiller system configured to circulate a process fluid along a heat exchange line of the chiller system;

wherein the chiller system is coupled to the reversible heat pump system so that there is a process fluid circuit defined between the chiller system and the reversible heat pump system including a process fluid line of the chiller system and the process fluid pathway of the second heat exchanger of the reversible heat pump system;

wherein the chiller system is configured to pump the process fluid around the process fluid circuit so that it flows through the process fluid pathway of the second heat exchanger from the process fluid inlet to the process fluid outlet.

The process fluid may comprise water and a coolant such as glycol, ethylene glycol, propylene glycol, calcium chloride, methanol, ethanol. The process fluid may comprise substantially 100% water (i.e. without an added coolant).

The controller(s) described herein may comprise a processor. The controller and/or the processor may comprise any suitable circuitry to cause performance of the methods described herein and as illustrated in the Figures. The controller or processor may comprise: at least one application specific integrated circuit (ASIC); and/or at least one field programmable gate array (FPGA); and/or single or multi-processor architectures; and/or sequential (Von Neumann)/parallel architectures; and/or at least one programmable logic controllers (PLCs); and/or at least one microprocessor; and/or at least one microcontroller; and/or a central processing unit (CPU), to perform the methods and or stated functions for which the controller or processor is configured.

The controller may comprise or the processor may comprise or be in communication with one or more memories that store that data described herein, and/or that store machine readable instructions (e.g. software) for performing the processes and functions described herein (e.g. determinations of parameters and execution of control routines).

The memory may be any suitable non-transitory computer readable storage medium, data storage device or devices, and may comprise a hard disk and/or solid state memory (such as flash memory). In some examples, the computer readable instructions may be transferred to the memory via a wireless signal or via a wired signal. The memory may be permanent non-removable memory, or may be removable memory (such as a universal serial bus (USB) flash drive). The memory may store a computer program comprising computer readable instructions that, when read by a processor or controller, causes performance of the methods described herein, and/or as illustrated in the Figures. The computer program may be software or firmware, or be a combination of software and firmware.

The skilled person will appreciate that except where mutually exclusive, a feature described in relation to any one of the above aspects may be applied mutatis mutandis to any other aspect. Furthermore, except where mutually exclusive any feature described herein may be applied to any aspect and/or combined with any other features described herein.

INTRODUCTION TO THE DRAWINGS

DETAILED DESCRIPTION

Figure 1:
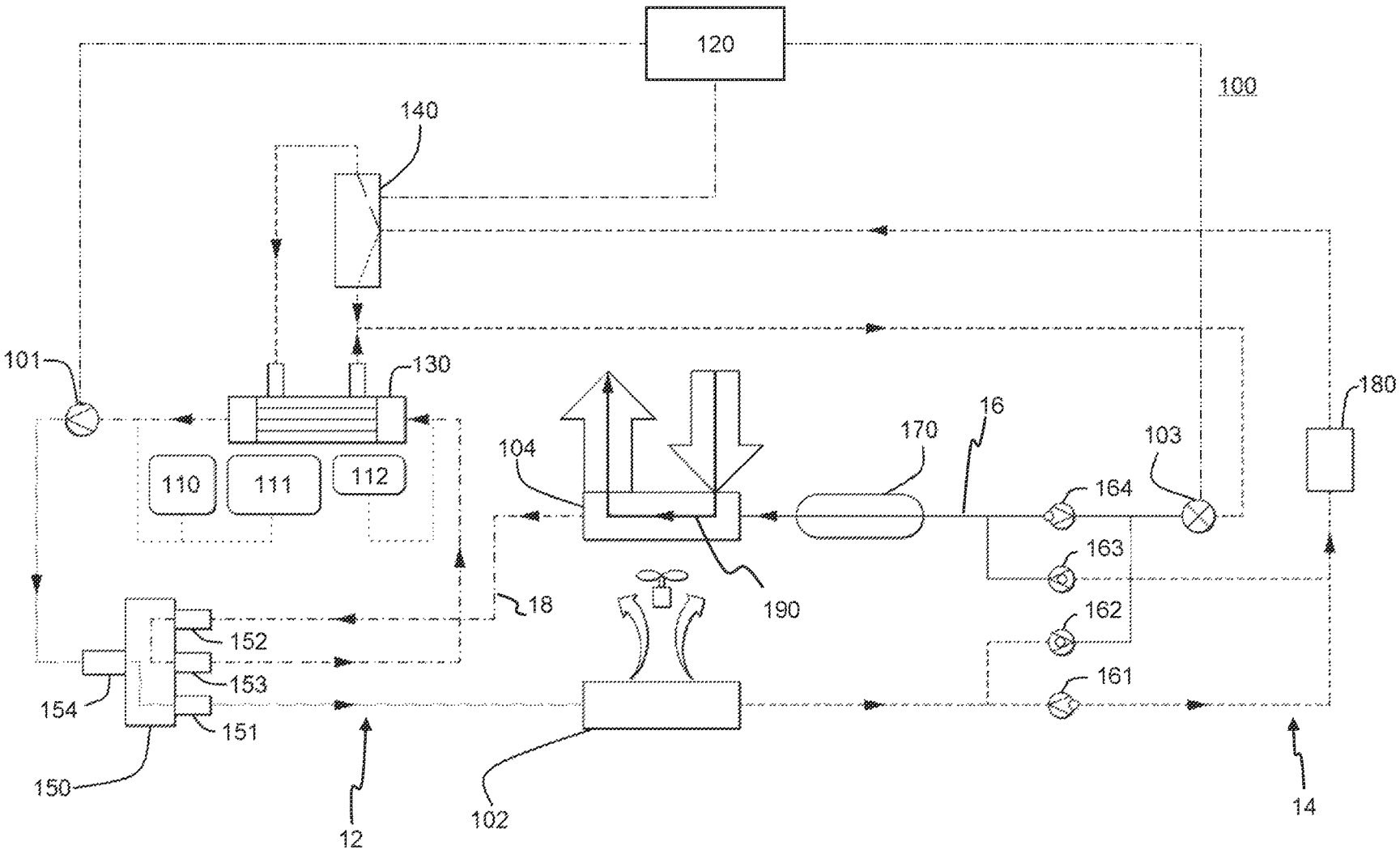
FIG. 1 shows an example schematic of a reversible heat pump system in a cooling configuration.
Figure 2:
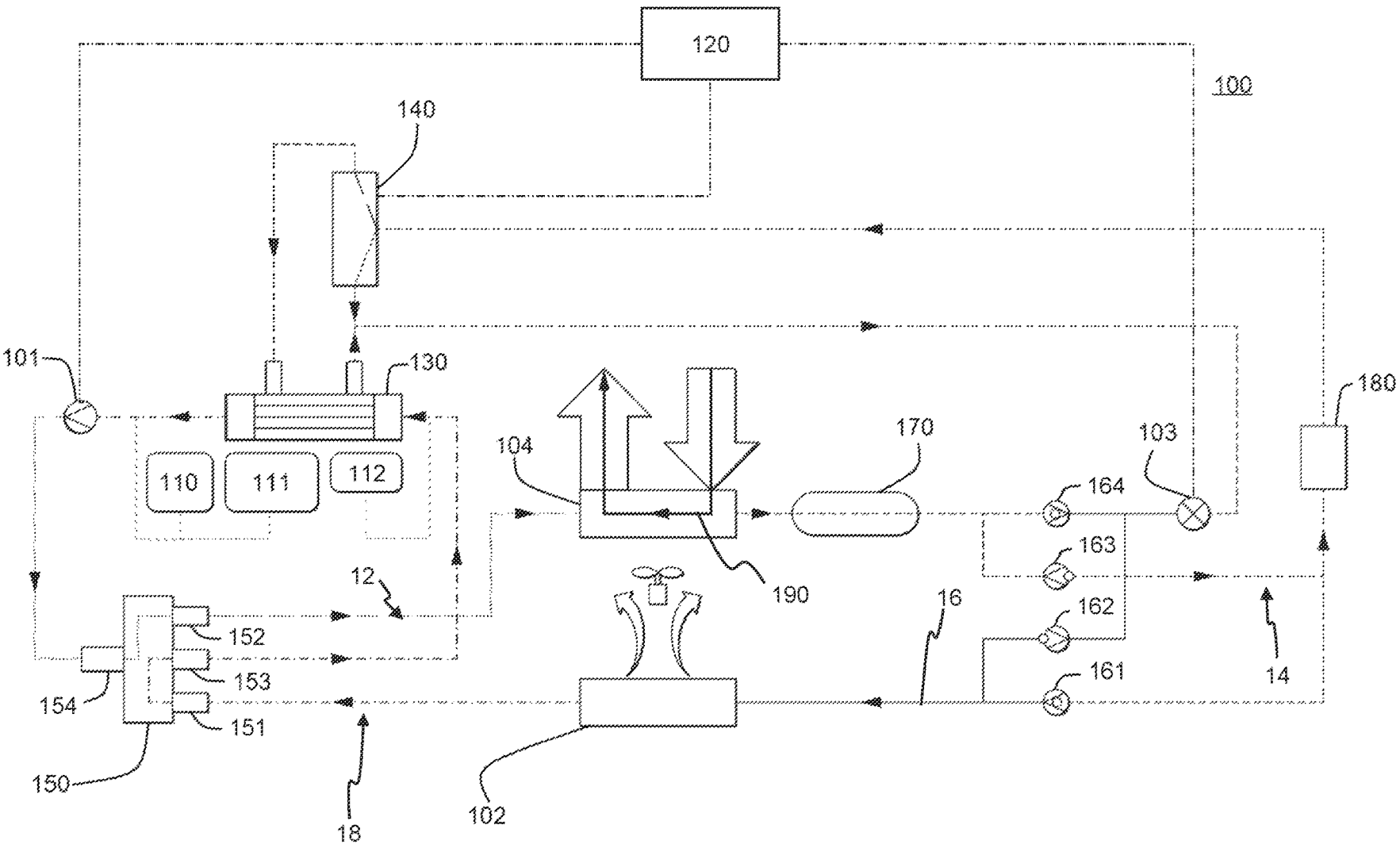
FIG. 2 shows an example schematic of the reversible heat pump system of FIG. 1 in a heating configuration.

FIGS. 1 and 2 show a reversible heat pump system 100 (in particular, a vapor compression system) for heat exchange with a process fluid of a chiller system, the system being operable in a cooling configuration and a heating configuration (which may also be referred to as a cooling mode and a heating mode respectively herein).

An example cooling configuration is shown in FIG. 1 and an example heating configuration is shown in FIG. 2. When in the heating configuration, the reversible heat pump system is configured to heat the process fluid of the chiller system. When in the cooling configuration, the reversible heat pump system is configured to cool the process fluid of the chiller system.

The reversible heat pump system is to be charged with a working fluid (in particular, a refrigerant for a vapor compression cycle, such as R-1410A), and comprises: a compressor 101 (such as a scroll or screw compressor) configured to compress the working fluid; a first heat exchanger 102 configured for heat exchange between the working fluid and an external medium; an expansion device 103 configured to expand the working fluid; and a second heat exchanger 104 configured for heat exchange between the working fluid and the process fluid of the chiller system. The chiller system is not shown in FIG. 1, except for a process fluid pathway through the second heat exchanger 104 although a showing a process fluid pathway 190 through the second heat exchanger 104, depicted together with block arrows indicating a connection to the remainder of a system circulating the process fluid.

In each configuration, one of the heat exchangers 102, 104 functions as a condenser heat exchanger for heat rejection from the working fluid and the other functions as an evaporator heat exchanger for receiving heat into the working fluid.

In the cooling configuration, the first heat exchanger 102 functions as the condenser heat exchanger and the second heat exchanger 104 functions as the evaporator heat exchanger. In flow order from the compressor, and making use of common terminology in the art for the respective fluid lines, the components are fluidically coupled as follows. In the following description, the respective fluid lines may be described without reference to components located part-way along the line.

The compressor 101 and the condenser heat exchanger 102 are fluidically coupled by a discharge line pathway 12 (indicated by a dotted line). The condenser heat exchanger 102 and the expansion device 103 are fluidically coupled by a liquid line pathway 14 (indicated by a dashed line). The expansion device 103 and the evaporator heat exchanger 104 are fluidically coupled by a distributor line pathway 16 (indicated by a solid line). The evaporator heat exchanger 104 and the compressor are fluidically coupled by a suction line pathway (indicated by a dash-dot line).

In use the working fluid flows through the main components introduced above as follows, although as will become clear from the further description below, the system includes additional components that interact with the working fluid. The working fluid received at the compressor 101 from the suction line pathway 18 is at relatively low temperature and pressure, and is gaseous. The compressor 101 compresses the working fluid so that it is provided along the discharge line pathway 12 at relatively high temperature and pressure to the first heat exchanger 102 (acting as the condenser heat exchanger). The working fluid condenses in the condenser heat exchanger as it rejects heat to the external medium, such that the working fluid carried by the liquid line pathway 14 is liquid. The working fluid is expanded at the expansion device 103 so that it reduces in pressure and temperature, and is carried by the distributor line pathway 16 as biphasic (multiphase) liquid-gas to the second heat exchanger 104 (acting as the evaporator heat exchanger). The working fluid is vaporised within the evaporator heat exchanger 104 as it receives heat from the process fluid of the chiller system within the process fluid pathway 190, and is recirculated back to the compressor along the suction line pathway 18.

The reversible heat pump system further comprises a valve system configured to switch the reversible heat pump system between the cooling configuration and the heating configuration.

In this particular example, the valve system comprises a four-way valve disposed between the compressor and the heat exchangers 102, 104. The four-way valve is configured so that working fluid flows along a constant direction through a compressor loop of the heat pump system, and so that working fluid selectively flows in opposing directions through a heat exchange loop of the heat pump, depending on whether the heat pump system is in the cooling configuration or the heating configuration.

In this example, the four-way valve is configured to selectively direct working fluid received from the compressor 101 at a compressor discharge port 154 to either:

- a first port 151 in communication with the first heat exchanger 102 for flow around the heat exchange loop in a first direction in the cooling configuration of the heat pump system (as shown in FIG. 1); or
- a second port 152 in communication with the second heat exchanger 104 for flow around the heat exchange loop in a second reversed direction in the heating configuration of the heat pump system (as shown in FIG. 2).

The working fluid is received back at the four-way valve from whichever of the first and second ports 151, 152 did not receive the working fluid from the compressor, and the four-way valve is configured to redirect the working fluid received from the respective valve to a compressor supply port 153 to flow through the compressor loop.

Accordingly, in this example the suction line pathway and the discharge line pathway flow through the four-way valve. Further, the suction line pathway and the discharge line pathway differ between the cooling and heating configurations, at least in the heat exchange loop. For example, the suction line pathway differs between the cooling configuration and the heating configuration, as it extends along a fluid line between the second heat exchanger 104 (acting as the evaporator heat exchanger) and the second port 152 of the four-way valve in the cooling configuration, but extends along a different fluid line between the first heat exchanger 102 (acting as the evaporator heat exchanger) and the first port 151 of the four-way valve in the heating configuration.

Some types of compressors are suitable for the compression of dry working fluids (i.e. working fluids in the vapour phase) only, such that their performance is adversely affected by the presence of any condensate (working fluid in the liquid phase), for example liquid slugs, rivers or droplets (which are terms of the art). The ingestion of a multiphase working fluid into a compressor may result in liquid slugging, which is associated with loss of compressor performance, equipment damage and early component failure. In order to mitigate the risk of liquid slugging, the heat pump system may be operated so that the working fluid is superheated upon entry to the compressor.

A working fluid is superheated when it is at a higher temperature than its saturation temperature at the respective pressure, by an amount referred to as a superheat. To mitigate against the possibility of local temperature gradients that may lead to condensation, a gas may be heated to a threshold superheat (i.e. a minimum amount of superheat).

To protect the compressor 101 from liquid slugging, a threshold superheat of the working fluid provided to the compressor inlet may be specified in the control of the heat pump system. The threshold superheat specified may be, for example, 6° C. Since the saturation temperature of a gas is a function of pressure, it is possible to achieve a threshold superheat by controlling the pressure of the gas and/or the absolute temperature of the gas.

In the reversible heat pump system 100, the pressure of the working fluid provided to the compressor 101 along the suction line pathway may be varied by control of the expansion device 103. The reversible heat pump system comprises a controller 120 configured to control the operation of the expansion device 103 and related sensing equipment. In this example, the reversible heat pump system comprises a first temperature sensor 111 and a first pressure sensor 110 coupled to the controller 120 and configured to produce signals corresponding to the respective temperature and pressure of the working fluid provided to the compressor.

The sensors may produce signals encoding the monitored temperature and pressure respectively; may encode temperature and pressure parameters from which the monitored temperature and pressure can be derived; or may encode temperature and pressure parameters which are a function of the monitored temperature and pressure. The controller may be further configured to store information relating to the type of working fluid provided to the suction line pathway. In particular, the information may provide a relationship between a pressure parameter and saturation temperature for a type of working fluid, for example a mathematical relationship or tabular information to permit a lookup or interpolation of the relationship. The information may comprise a database of such relationships for a plurality of types of working fluid, and the controller may be configured to select a particular type of working fluid corresponding to that disposed within the system, for example based on user input.

In this example, the controller 120 is configured to determine a suction line saturation temperature, a suction line absolute temperature and a suction line superheat of the working fluid at a respective monitoring location along the suction line based on signals received from the first temperature sensor 111 and the first pressure sensor 110, and based on the information corresponding to the type of working fluid. In this example the first temperature sensor 111 and the first pressure sensor 110 are disposed together at the same monitoring location, but in other examples they may be spaced apart along the suction line, for example either side of a suction line economizer heat exchanger (to be described below). In such cases, the monitoring location for monitoring superheat corresponds to the location of the first temperature sensor 111 in the suction line, whereas a pressure signal from a the pressure sensor 110 disposed upstream or downstream of the monitoring location may be relied upon. There may be a negligible pressure difference between the remote location and the location of the first temperature sensor, or a predicted or known pressure difference between them may be taken into account by the controller 120.

As will be appreciated, the controller may implement control of the expansion device 103 without determining physical (i.e. actual) pressure and/or temperature values. For example, the controller may be calibrated to control the expansion device 103 as described herein, based on temperature and pressure parameters which are related to the actual temperature and/or pressure.

The controller 120 is configured to control the expansion device 103 to maintain a target superheat at the respective monitoring location along the suction line. In this example, the monitoring location is immediately upstream of the compressor and downstream of a suction line economizer heat exchanger which is to be described below. The controller 120 is configured to increase the superheat by reducing a flow rate through the expansion device (i.e. by progressively closing a valve of the expansion device), thereby permitting an increased pressure drop to a lower pressure in the suction line. This results in a lower saturation temperature and thereby a higher superheat given the same absolute temperature of the working fluid. It may be that with a reduced mass flow rate, the working fluid is raised to a higher temperature at the evaporator heat exchanger, thereby increasing the superheat further. The controller is configured to decrease the superheat by increasing the flow rate through the expansion device for the opposite effects.

In other examples, the first temperature sensor 111 may be disposed along the suction line such that there is other components along the suction line between the monitoring location and the inlet of the compressor (such as a suction line economizer heat exchanger, as will be described below).

In this example, the reversible heat pump system 100 further comprises a suction line economiser heat exchanger (SLEHX) 130, configured to place working fluid in the suction line pathway 18 and working fluid in the liquid line pathway 14 in heat exchange communication. The SLEHX 130 has the effect of removing heat from working fluid in the liquid line pathway 14 prior to expansion and evaporation, and transferring this heat to raise the temperature of the working fluid in the suction line pathway 18. It may therefore be considered to reheat the working fluid carried by the suction line pathway 18 upstream of the compressor 101. This reduces the mechanical power required to be supplied to the compressor 101 in order to cause the same heat transfer rate to the process fluid of the chiller system. In particular, it permits heat to be temporarily transferred out of the working fluid for flow through the expansion device 103 and through the evaporator heat exchanger, thereby permitting the working fluid to reach a relatively low temperature at the evaporator heat exchanger for heat exchange with the process fluid. In the absence of the SLEHX 130, the only means to reduce the temperature at the evaporator heat exchanger 104 would be to cause a larger pressure drop in the system by control of the compressor 101 and expansion device 103.

As a result, the overall efficiency of the heating and cooling cycles may be increased by use of the suction line economiser heat exchanger 130.

The reversible heat pump system 100 may be controlled so that heat transfer to evaporate the working fluid occurs predominantly or exclusively in the evaporator heat exchanger, and as a corollary only sensible heating occurs in the SLEHX 130. Such control can be advantageous in that it permits system stability and simplicity of control, since the SLEHX 130 can be controlled to maintain a target temperature increase over the SLEHX 130 by simply monitoring inlet and outlet temperatures (as will be described below), while there can be separate control of the expansion device 103 to ensure that evaporation is completed at the evaporator heat exchanger. In contrast, system control may be more complex if evaporation were permitted to occur in the SLEHX, for example it may be necessary to install a dryness sensor between the evaporator heat exchanger and the SLEHX 130 in order to determine the enthalpy of the flow at an intermediate point, such that the heat transfer rates at the evaporator heat exchanger and the SLEHX can be suitably controlled.

Further, controlling the system so that the working fluid is completely evaporated in the evaporator heat exchanger can be advantageous in that different types of heat exchanger can be selected, each having varying performance for evaporation and sensible heating respectively. A type of heat exchanger optimised for evaporation can be selected for the evaporator heat exchanger. It is therefore advantageous to limit the amount of sensible heating performed in the evaporator heat exchanger, to thereby maximise how much of the evaporator heat exchanger is used for evaporation. Similarly, a type of heat exchanger optimised for sensible heating can be selected for the SLEHX 130, or a more simple and inexpensive heat exchanger can be used if there is no requirement to perform evaporation there. Such heat exchangers may not be able to efficiently evaporate liquid droplets contained in a multiphase fluid flowing therethrough, and so it may be desirable to provide the working fluid to the SLEHX with a target superheat. Moreover, it may be that the heat exchange performance of the SLEHX is adversely affected if it receives multiphase working fluid, such that it may fail to both evaporate the liquid fraction and perform sufficient sensible heating to avoid liquid slugging at the compressor 101.

The reversible heat pump system further comprises a modulation device 140 configured to modulate heat exchange between working fluid in the suction line pathway 18 and in the liquid line pathway 14 at the SLEHX 130. In this particular example, the modulation device is a three-way valve 140 disposed along the liquid line pathway 14 and configured to modulate the heat exchange by controlling a proportion of working fluid received from the condenser heat exchanger which flows through the SLEHX, for example at any continuous setting from 0% to 100% of the flow, inclusive. A remaining proportion of the working fluid which does not flow through the SLEHX is directed by the three-way valve to flow directly to the expansion device 103. Other valve arrangements could be used to similar effect, such as by providing separate branches to the SLEHX and to the expansion device 103, one or both having a control valve (modulation device) for varying the proportion of working fluid received from the condenser heat exchanger which flows through the SLEHX. Alternative means of modulation are possible.

The controller 120 is configured to control the operation of the modulation device 140. In this example, the reversible heat pump system 100 comprises a second temperature sensor 112 configured to produce a signal corresponding to the temperature of the working fluid in the liquid line upstream of the SLEHX 130. The second temperature sensor 112 may produce a signal encoding the monitored temperature, may encode a temperature parameter from which the monitored temperature can be derived, or may encode a temperature parameter which is a function of the monitored temperature.

In this example, the controller is configured to operate the modulation device 140 to maintain a target temperature difference in the working fluid through the SLEHX (i.e. between the location of the second temperature sensor 120 and the location of the first temperature sensor 111) based on the signals received from the first and second temperature sensors. In this particular example, the controller is configured to determine the absolute temperatures of the working fluid in the suction line upstream and downstream of the SLEHX 130 based on the respective signals from the sensors 112, 111, but it will be appreciated that in other examples the controller may be calibrated to control the modulation device 140 based on temperature parameters which are related to the respective temperatures but are not necessarily equal to them.

In conjunction with the control of the expansion valve 103 as described above, the magnitude of the temperature difference may be selected to ensure that working fluid entering the SLEHX 130 is superheated. For example, if the expansion valve 103 is controlled so that the working fluid provided to the compressor has a superheat of 6° C., the target temperature difference may be set to 4° C. to ensure that the working fluid in the suction line has a superheat of 2° C. as it is provided to the SLEHX.

In view of the above discussion, it will be appreciated that other control arrangements are possible with the same or similar objectives. For example, the expansion valve 103 could be controlled to maintain a target superheat in the working fluid discharged from the evaporator heat exchanger (e.g. a superheat of 2° C.), and the modulation device could be controlled to maintain a target temperature difference over the SLEHX 130 (e.g. 4° C. of superheating), or to maintain a target superheat in the working fluid discharged from the SLEHX.

An example of steady state operation in the cooling configuration will now be described with reference to purely exemplary temperatures.

The working fluid carried by the suction line pathway 18 upstream of the SLEHX 130 is at an absolute temperature of 5° C. The saturation temperature of the working fluid carried by the suction line pathway 18 is 3° C., such that there is 2° C. of superheat. Downstream of the SLEHX 130, the working fluid carried by the suction line 105 is at an absolute temperature of 9° C. If the pressure of the working fluid is substantially constant throughout the suction line 105, the saturation temperature remains approximately 3° C., to provide 6° C. of superheat at the inlet to the compressor 101, in this example.

An example of steady state operation in the heating configuration will now be described with reference to purely exemplary temperatures. The working fluid carried by the suction line pathway 18 upstream of the SLEHX 130 is at an absolute temperature of −1° C. The saturation temperature of the working fluid carried by the suction line pathway 18 is −3° C., providing 2° C. of superheat. Downstream of the SLEHX 130, the working fluid carried by the suction line pathway 18 is at an absolute temperature of 3° C. If the pressure of the working fluid is substantially constant throughout the suction line pathway 18, the saturation temperature remains approximately −3° C., to provide 6° C. of superheat into the compressor, in this example.

In the example described above, a single SLEHX 130 is provided for use in both the cooling configuration and the heating configuration, and in each configuration the respective liquid line pathway 14 directs flow from the second heat exchanger through the SLEHX 130 and then to the expansion device 103. This may be achieved using routing valves to suitably direct the flow in the two configurations such that there is a common liquid line portion which is common to the liquid line pathways 14 in both configurations for one-way flow from the SLEHX to the expansion device 103.

In the particular example of FIGS. 1 and 2, the valve system comprises routing valve arrangements disposed between each of the first and second heat exchangers 102, 104 and the expansion device 103. Each routing valve arrangement is configured so that, when the respective heat exchanger 102, 104 serves as the condenser heat exchanger, the valve arrangement prevents flow passing directly from the condenser heat exchanger to the evaporator heat exchanger, and instead directs it to flow along the common liquid line—i.e. to the SLEHX 130 and then to the expansion device 103. More particularly, in this example the common liquid line comprises in flow order an optional filter device 180, the modulation device 140, the SLEHX 130 and the expansion device 103.

Further, each routing valve arrangement is configured so that, when the respective heat exchanger 102, 104 serves as the evaporator heat exchanger, the valve arrangement permits flow to pass directly from the expansion device 103 to the respective heat exchanger (i.e. without intervening flow along the common liquid line), while preventing fluid communication from the respective heat exchanger to the common liquid line.

For example, as shown in FIGS. 1 and 2 there is a first routing valve arrangement comprising a first check valve 161 between a condenser outlet side of the first heat exchanger 102 (i.e., the side of the first heat exchanger which outlets working fluid when operating as a condenser) and the common liquid line to permit one-way flow to the common liquid line and the downstream expansion device 103 from the first heat exchanger 102 in a cooling configuration, and a second check valve 162 between the condenser outlet side of the first heat exchanger 102 and the expansion device 103 to prevent flow from the first heat exchanger 102 to the expansion device 103 in the cooling configuration. In the heating configuration, the second check valve 162 permits one-way flow from the expansion device 103 to the first heat exchanger 102 acting as an evaporator heat exchanger.

Further, there is a second routing valve arrangement comprising a third check valve 163 between a condenser outlet side of the second heat exchanger 104 (i.e., the side of the second heat exchanger which outlets working fluid when operating as a condenser) and the common liquid line to permit one-way flow to the common liquid line and the downstream expansion device 103 from the second heat exchanger 104 in a cooling configuration, and a fourth check valve 164 between the condenser outlet side of the second heat exchanger 104 and the expansion device 103 to prevent flow from the second heat exchanger 104 to the expansion device 103 in the heating configuration. In the cooling configuration, the fourth check valve 164 permits one-way flow from the expansion device 103 to the second heat exchanger 104 acting as an evaporator heat exchanger.

Because the second heat exchanger 104 functions as the evaporator heat exchanger in the cooling configuration and as the condenser heat exchanger in the heating configuration, the direction of working fluid flow therethrough changes when the reversible heat pump system is switched from one mode to another. The direction of process fluid flow is however constant, with the second heat exchanger having a process fluid inlet, a process fluid outlet and a process fluid pathway 190 therebetween for heat exchange between the process fluid provided from the chiller system and the working fluid provided to the second heat exchanger 104. As a result, the process fluid and the working fluid are provided to the second heat exchanger 104 for counter-current flow in one configuration and for co-current flow in the other configuration.

It is well understood in the art that co-current flow heat exchangers are less efficient than counter-current flow heat exchangers, with a co-current arrangement in an evaporator heat exchanger generally requiring a greater approach than would be required for a counter-current flow heat exchanger, given the same conditions of the process fluid and the mass flow rate of the working fluid. In an evaporator heat exchanger, the approach temperature is the difference between the exit temperature of a given process fluid and the entry temperature of a given working fluid. Therefore, in order to provide a target process fluid exit temperature, co-current flow evaporator heat exchangers require the working fluid to have a relatively lower entry temperature.

A chiller system for a building or installation may demand process fluid be cooled to a low temperature for comfort cooling applications, such as between 5° C., Water is a popular choice of process fluid, and has a freezing temperature of 0° C. In previously-considered reversible heat pump systems, the process fluid of the chiller system is provided to an evaporator heat exchanger for counter-current flow with the working fluid in a cooling mode, and for co-current flow with the working fluid when functioning as a condenser heat exchanger in a heating mode. The freezing risk at the evaporator heat exchanger in the cooling mode, in conjunction with a requirement to ensure dry (superheated) working fluid into the compressor may be considered to be the critical design condition for previously-considered reversible heat pump systems, in that the configuration and operating parameters are selected to minimise the freezing risk. The heat exchanger which exchanges heat with the process fluid is typically a refrigerant-to-liquid (e.g. a refrigerant-to-refrigerant) heat exchanger, such that the process fluid would freeze within an internal component of the heat exchanger. In contrast, the heat exchanger which exchanges heat between the working fluid and the environment (e.g. ambient air) is typically a refrigerant-to-air heat exchanger, such as a fin and tube or coil heat exchanger.

In particular, because the expanded flow provided to the evaporator heat exchanger is multiphase, the approach temperature is the difference between the saturation temperature of the working fluid at the evaporator and the exit temperature of the process fluid. In the absence of an SLEHX (contrary to the invention), there may be a requirement for the working fluid to exit the evaporator with a superheat safety margin (for example 6° C. of superheat) to protect the downstream compressor. Consequently, for a target process fluid exit temperature of 5° C. and a corresponding working fluid exit temperature of 5° C., the saturation temperature may be required to be as low as −1° C. This may approach the limit of an acceptable freezing risk within the evaporator heat exchanger, while also requiring a significant pressure ratio at the expansion device and a relatively low mass flow rate of working fluid to achieve both the low saturation temperature and sufficient sensible heating within the evaporator heat exchanger. The low mass flow rate may significantly limit the cooling capacity of the system (i.e. the mass flow rate of process fluid that it can be cooled to the specified target process fluid exit temperature).

If an SLEHX were to be provided in such arrangements (as is done in the invention), the expansion device could be controlled so that the mass flow rate of working fluid increases, the pressure ratio reduces and the saturation temperature at the evaporator increases. Nevertheless, in order to maximise the cooling capacity of the heat pump system, the saturation temperature would have to remain relatively low, for example 1° C.

Equivalent concerns regarding freezing in the heating mode (i.e. at the respective evaporator heat exchanger) do not tend to arise, since the evaporator heat exchanger in the heating mode typically receives heat from a bulk external medium that is not liquid, for example ambient air (e.g. a refrigerant-to-air heat exchanger, such as a fin and tube or coil heat exchanger). Further, while air may include water vapour that can condense and freeze on the evaporator heat exchanger, this freezing is typically on an external surface of the evaporator heat exchanger which exchanges heat with the bulk external medium, rather than an internal surface of a confined flow path. Accordingly, this presents no risk of ice accumulation within a component of the heat exchanger, and any ice accumulation can be simply removed periodically (e.g. by local heating or reversal of the heat pump).

For these reasons (and additional reasons relating to system startup, as will be discussed below), there is a focus in heat pump design to reduce the risk of freezing in the evaporator heat exchanger in the cooling mode while maximising mass flow rate, and the associated use of counter-current flow in the evaporator heat exchanger in the cooling mode to minimise the approach temperature.

In this sense, the inventors have diverged from the established technical prejudice of the technical field in relation to the flow direction in the evaporator heat exchanger. In particular, in the reversible heat pump system according to the invention, the process fluid of the chiller system is provided to the second heat exchanger 104 for co-current flow in the cooling configuration, and for counter-current flow in the heating configuration.

The freezing risk associated with the co-current flow at the second heat exchanger 104 is mitigated in steady-state operation by use of the SLEHX as described above, which effectively permits a smaller superheat in the working fluid exiting the second heat exchanger 104 (e.g. 2° C.) since further superheat is added in the SLEHX 130. This has the effect that the saturation temperature need not be lowered so severely by restricting mass flow through the expansion device, permitting a relatively higher saturation temperature at the second heat exchanger.

In addition, the inventors have determined that a freezing risk can be mitigated by operating the heat pump system to target an elevated process fluid exit temperature, in particular 7° C. for comfort cooling applications, whereas the inventors may have previously considered a process fluid exit temperature of 5° C.

The co-current flow reduces the cooling capacity of the system in the cooling configuration compared to the cooling capacity that could be achieved with a counter-current flow with all other parameters equal, owing to the need to reduce the saturation temperature at the second heat exchanger to accommodate the relatively higher approach temperature.

However, the inventors have found that the advantages of providing the process fluid to the second heat exchanger 104 for counter-current flow with the working fluid in the heating configuration outweigh the reduced cooling capacity in the cooling configuration, since the heating capacity of the system in the heating configuration is significantly increased.

Tables 1-3 below report example relative changes in performance parameters of the heat pump system, as compared with operation with the conventional flow direction of the process fluid (i.e. based on the same configuration of the heat pump system 100 but with the direction of the process fluid pathway reversed). The values reported in the tables correspond to example steady state conditions in which the process fluid is provided to the second heat exchanger 104 at 12° C. and exits at 7° C. in the cooling configuration, and is provided to the second heat exchanger at 40° C. to exit at 45° C. in the heating configuration. The process fluid is water and the refrigerant in this example is R-410A. In tables 1 and 2, comparative information for a third configuration is reported in which the modulation device prevents heat exchange at the SLEHX 130, effectively simulating a configuration in which there is no SLEHX.

As can be seen from tables 1 and 2, in the absence of a SLEHX, there is a large reduction in mass flow rate (and thereby cooling capacity) in the cooling mode, which is associated with achieving a lower saturation temperature at the evaporator heat exchanger such that the working fluid is discharged from the evaporator heat exchanger at a suitable superheat for entry into the compressor. Owing to the lower mass flow rate, the power is also reduced (but not by as much as the mass flow rate). Conversely, in the heating mode there remains a benefit to the counter-current arrangement at the evaporator heat exchanger even in the absence of the SLEHX and with less power demand,

TABLE 1

Cooling Configurations

| Configuration | Change in mass flow rate of working fluid | Change in power demand |
|---|---|---|
| Cooling—counter-current flow | ±0% | ±0% |
| Cooling—co-current flow | −2% | +0% |
| Cooling—co-current flow with the modulation device preventing heat exchange at the SLEHX. | −9% | −4% |

TABLE 2

Heating Configurations

| Configuration | Change in mass flow rate of working fluid | Change in power demand |
|---|---|---|
| Heating—co-current flow | ±0% | ±0% |
| Heating—counter-current flow | +2.5% | −2.5% |
| Heating—counter-current flow with the modulation device preventing heat exchange at the SLEHX. | +1.5% | −2.5% |

TABLE 3

Comparison of capacity and efficiency changes in different configurations

| Configuration | Change in capacity | Change in efficiency |
|---|---|---|
| Cooling—counter-current flow | ±0% | ±0% |
| Cooling—co-current flow | −2% | −2% |
| Heating—co-current flow | ±0% | ±0% |
| Heating—counter-current flow | +2% | +4% |

The improved performance in the heating mode (with SLEHX) is related to the lower approach temperature at the second heat exchanger (serving as the condenser heat exchanger). At the example operating conditions discussed above, the gas temperature on entry to the second heat exchanger 104 is required to be 49° C. in order to achieve the 45° C. process fluid exit temperature with co-current flow at the second heat exchanger 104, but only 46° C. to with counter-current flow. Accordingly, the pressure ratio can be reduced when there is counter-current flow, and the mass flow is increased.

Figure 3:
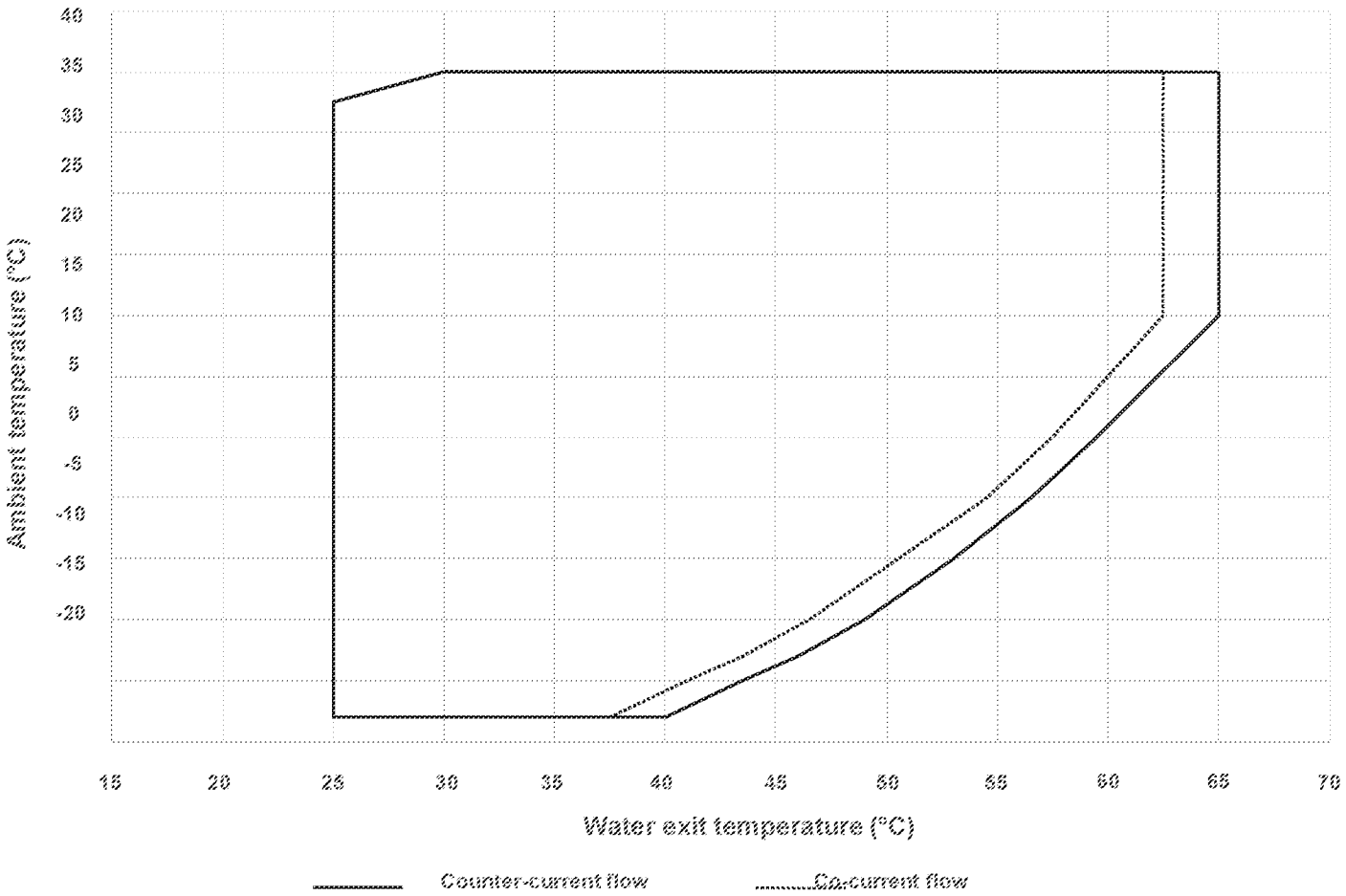
FIG. 3 shows an illustrative operating map of a reversible heat pump system in a heating configuration.

The improved efficiency and reduced power demand in the heating mode effectively extends the operating map of the heat pump system in the heating mode. For example, as shown in the operating map of FIG. 3 for the system 100 described above, range of operating conditions is extended to accommodate heating to water exit temperatures 2.5° C. higher than with the same system with co-current flow at the second heat exchanger (serving as condenser heat exchanger).

As mentioned above, freezing risk may be a concern during a start-up phase of operating a heat pump system in a cooling configuration. During a start-up phase, flow is initially restricted through the expansion device, which helps a pressure difference to become established across the compressor and results in superheated working fluid being provided to the compressor inlet. In particular, the flow restriction results in a low downstream pressure at the second heat exchanger 104 (acting as the evaporator heat exchanger), and thereby a low saturation and absolute temperature of the working fluid as it is provided to the second heat exchanger. Given the low initial mass flow rate, the working fluid is generally fully evaporated and superheated within the second heat exchanger 104 and/or the SLEHX 130. Nevertheless, owing to the low absolute temperature of the working fluid provided to the second heat exchanger 104, the process fluid may be in heat exchange relationship with working fluid that is below its freezing point (e.g. below ° C. for water as a process fluid).

As the pressure in the reversible heat pump system builds up with time, the temperatures at locations around the system gradually increase. Nevertheless, in the time period immediately after compressor start up (and potentially after each additional compressor in a multi-compressor system is activated), the saturation temperature and absolute temperature of the working fluid into the second heat exchanger may fall to such an extent that there is a risk of localised freezing of the process fluid within the second heat exchanger 104 (e.g. where the process fluid is in heat exchange with multiphase working fluid at the low saturation temperature, such as near the inlet for working fluid into the second heat exchanger 104).

For these reasons, a heat pump system may be configured to issue an alarm and/or shutdown the system when conditions indicative of an excessive freezing risk are determined. In the example system 100 of FIGS. 1 and 2, the controller is configured to issue an alarm signal if it determines conditions indicative of an excessive freezing risk. In this particular example, such a determination is made based on the pressure and/or saturation temperature of working fluid provided to the second heat exchanger 104 (serving as the evaporator heat exchanger in the cooling mode). It will be appreciated that the pressure of the working fluid between expansion device 103 and the compressor 101 determines the saturation temperature of the working fluid, which corresponds to the absolute temperature of the working fluid as it is provided to the second heat exchanger 104 in the cooling configuration. The pressure may reduce as the working fluid flows through the second heat exchanger 102 and along the suction line pathway 18 to the SLEHX 130, but it may be that such pressure drops are relatively constant, such that with suitable calibration a relationship can be defined between pressure (and thereby saturation temperature) at any location along the line and the pressure at a monitoring location.

By way of example, the controller may be configured to determine if the signal received from the pressure sensor 110 is below a threshold corresponding to an excessive freezing risk, and/or if it corresponds to a saturation temperature for the respective working fluid which is indicative of an excessive freezing risk. In a previously-considered heat pump system with counter-current flow at the second heat exchanger (and therefore outside of the scope of the invention), the inventors proposed a low refrigerant temperature control (LRTC) threshold for issuance of such an alarm or shutdown of the system corresponding to a saturation temperature of −5° C., for a heat pump system used with a water-based chiller system.

The inventors have determined that in the cooling configuration of the reversible heat pump system according to the invention, for use with a water-based chiller system, a LRTC threshold corresponding to −7° C. can be set, such that the controller issues an alarm signal or shuts down the system at conditions corresponding to a saturation temperature of the working fluid of −7° C. or less. This lower threshold takes into account that the co-current flow regime in the second heat exchanger 104 is less effective in transferring heat with the process fluid, and therefore the controller will tend to operate the heat pump system to achieve relatively lower saturation temperatures as a result of it being configured to target the working fluid being provided to the suction line economiser heat exchanger 130 with a superheat (e.g. of 2° C.). The lower saturation temperatures would tend to increase the risk of localised freezing in the second heat exchanger 104.

However, the inventors have determined that since the pressure in the system recovers relatively quickly (in the order of 30-60 seconds), the saturation temperature likewise soon recovers from a negative peak relatively quickly. Accordingly, the risk of localised freezing is transient and reduced after this time period has elapsed, and the inventors have determined that a further reduction in the LRTC threshold can be safely accommodated in order to protect the compressor 101 from the liquid slugging.

Figure 4:
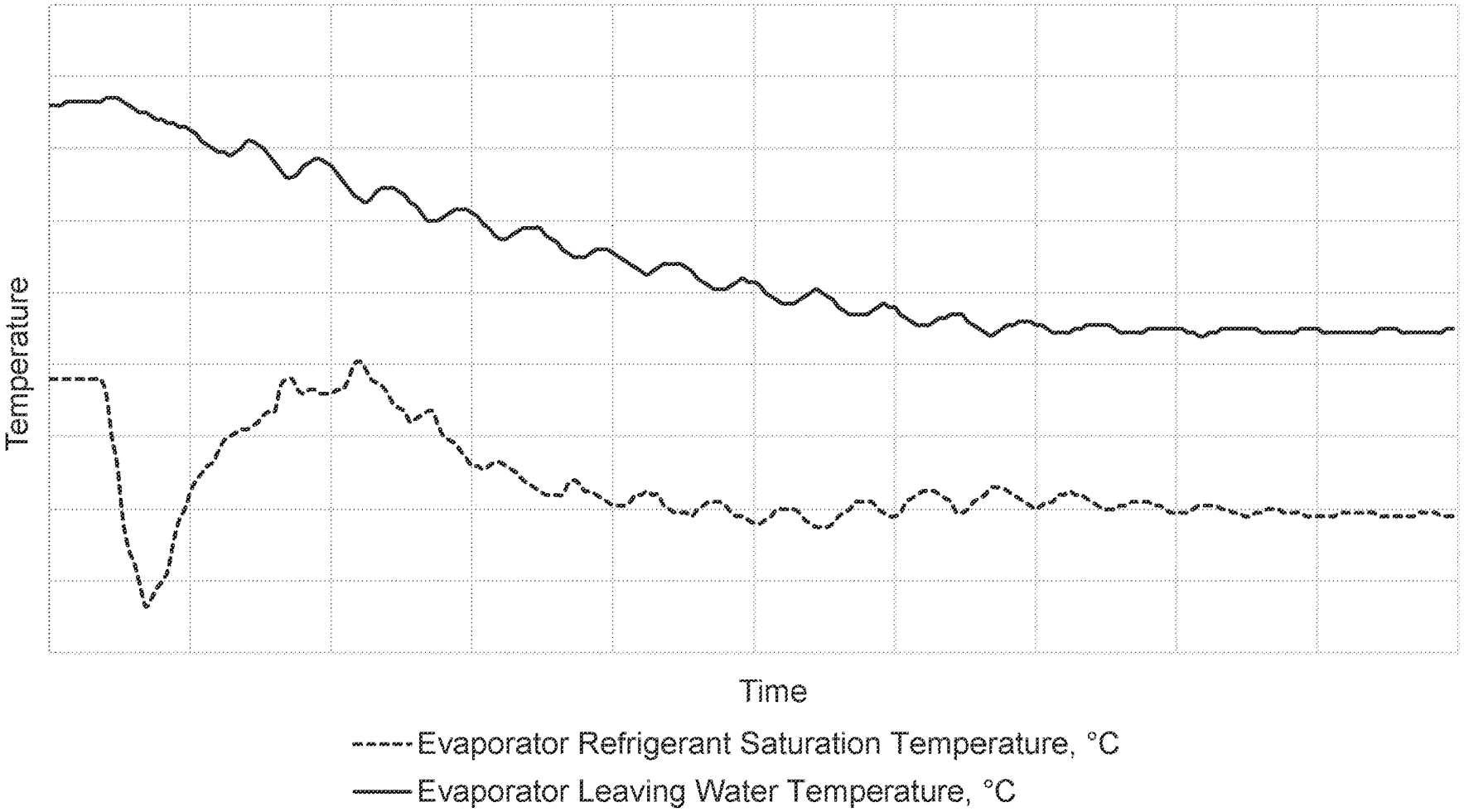
FIG. 4 shows an example schematic of a chiller system including the reversible heat pump system of FIGS. 1 and 2.

By way of example, FIG. 4 shows a transient plot of evaporator refrigerant saturation temperature and evaporator leaving water temperature during a start-up operating phase of a test heat pump system according to the configuration described above. It is not considered necessary to disclose the actual temperatures observed during the test, because it is the trend which is important. As can be seen, there is a significant negative peak in the evaporator refrigerant saturation temperature during the start-up operating phase, which may temporarily provide very low temperatures in the second heat exchanger (acting as evaporator) and thereby subject the process fluid in the second heat exchanger to thermal contact with working fluid below its freezing point. Nevertheless, as discussed above the inventors have found that this negative peak quickly recovers to higher temperatures, such that the inventors have determined that a LRTC threshold can be safely reduced to avoid inadvertent alarms or shutdown of the system, without presenting a freezing risk.

It is thought that the provision of the suction line economizer heat exchanger as described herein enables the effects of the co-current flow arrangement (as compared with a counter-flow arrangement) at the evaporator heat exchanger in the cooling mode, namely the reduction in the saturation temperature at the evaporator, to be accommodated with minimal additional freezing risk. In particular, as described elsewhere herein the suction line economizer heat exchanger enables heat to be temporarily removed from the working fluid in the liquid line before it is expanded for evaporation in the evaporator heat exchanger, and returned to the vaporised working fluid downstream of the evaporator heat exchanger. This enables a low saturation temperature to be achieved at the evaporator, while permitting the working fluid to be discharged from the evaporator heat exchanger with a relatively low superheat (e.g. 2° C. as given in the above examples), since additional superheat for safe supply of the working fluid to the compressor (e.g. up to 6° C. as given in the above examples) can be provided by sensible heating in the suction line economizer heat exchanger. Co-current flow at the evaporator heat exchanger for cooling, and the associated advantages described herein, is therefore made possible without necessitating the addition of a coolant (or an increase in an amount of coolant) to lower a freezing temperature of the working fluid to mitigate a freezing risk. In contrast, a heat pump system without a suction line economizer heat exchanger would require expansion to a significantly lower saturation temperature in order to ensure that sufficient superheat is provided within the evaporator heat exchanger itself. Accordingly it is thought that such arrangements could not accommodate a further reduction of the saturation temperature that would be associated with use of co-current flow at the evaporator heat exchanger, particularly for comfort cooling applications. Such arrangements may rely on the addition of a coolant, which may adversely impact performance of the system.

Referring back to FIGS. 1 and 2, in the example shown the reversible heat pump system 100 further includes a receiver 170 disposed on the distributor line pathway 16 between the expansion device 103 and the second heat exchanger 104 in the cooling configuration, which corresponds to the an upstream part of the liquid line pathway 14 in the heating configuration of FIG. 2. The receiver 170 is configured to collect condensed working fluid discharged by the second heat exchanger 104 when used as a condenser heat exchanger (i.e. in the heating mode). The receiver may help the heat pump system adapt to operating in a wide range of operating conditions (i.e. different pressure ratios and rates of heat transfer into and out of the system). A receiver may be particularly useful when the refrigerant volume of the second heat exchanger 104 is large compared to the refrigerant volume of the first heat exchanger 102. The receiver also functions as a storage device for working fluid during a "pump-down" phase when the reversible heat pump system is shut down. Further, the receiver can be used to store working fluid charge whilst maintenance is conducted on other components of the reversible heat pump system.

To minimise risks associated with the presence of foreign substances in the working fluid, the reversible heat pump system may further comprise a filter-drier 180 positioned in a liquid line pathway, for example in the common liquid line upstream of the SLEHX 130 as shown in FIGS. 1 and 2.

Figure 5:
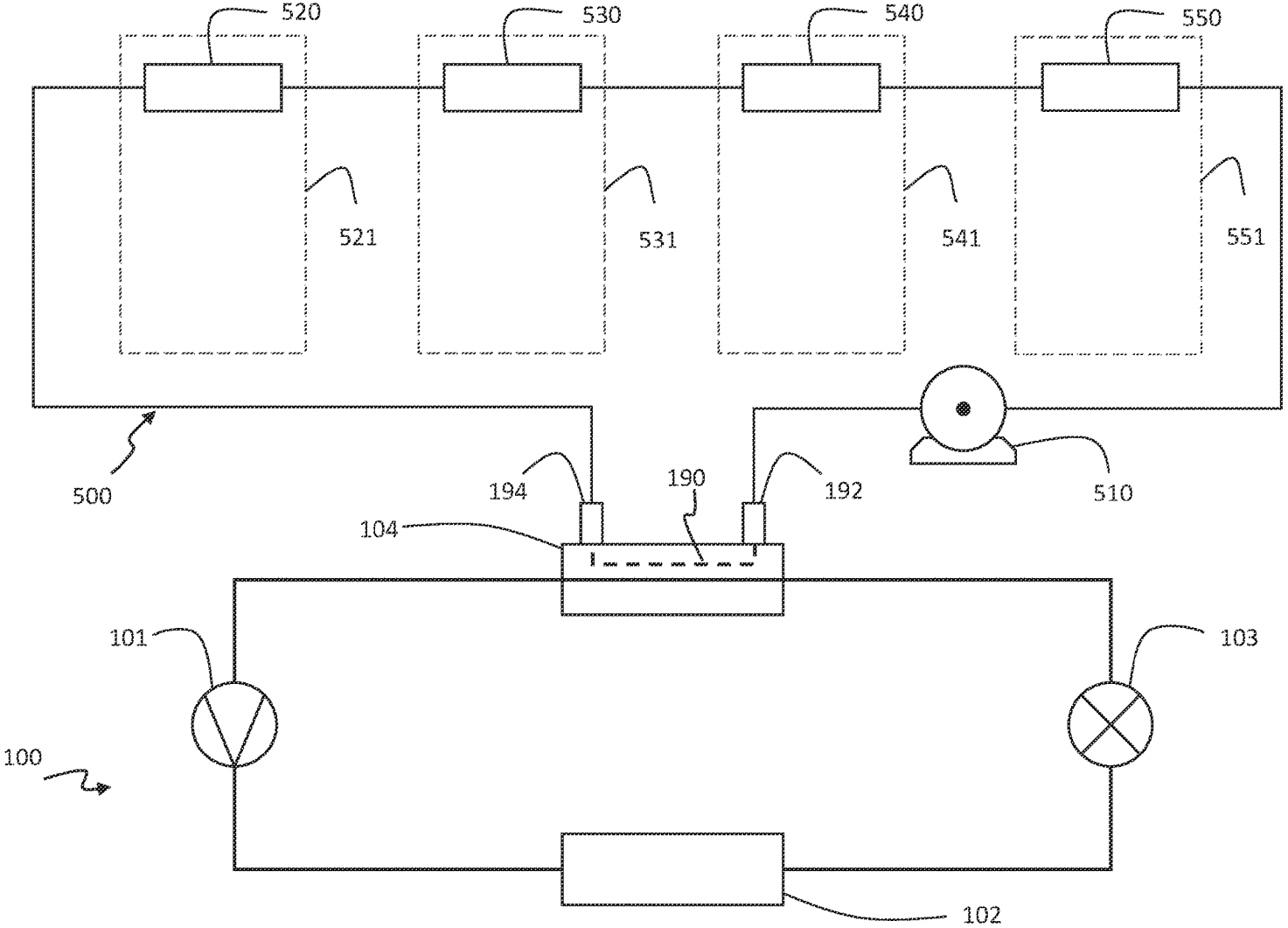
FIG. 5 is a plot of selected operating parameters during start-up of a reversible heat pump system in accordance with FIGS. 1 and 2.

For completeness, FIG. 5 shows an example chiller system 500 with which the heat pump system 100 of FIGS. 1 and 2 may be installed. The example heat pump system 100 is shown in FIG. 5 with only selected core components including the compressor 101, the first heat exchanger 102, the expansion device 103 and the second heat exchanger 104. It will be appreciated that this is for simplification of the drawing only, and a chiller system as described herein may be coupled to a heat pump system having any other components and configurations as envisaged elsewhere herein.

The example chiller system 500 defines a circuit for circulation of the process fluid. The circuit comprises the process fluid pathway 190 that extends through the second heat exchanger 104 of the heat pump system 100, extending between a process fluid inlet 192 and a process fluid outlet 194. In this example, the circuit further extends through a plurality of room heat exchangers 520, 530, 540, 550 configured to provide heating or cooling to the respective room 521, 531, 541, 551. The circuit also extends through a pump 510 configured to circulate the process fluid around the circuit.

Figure 6:
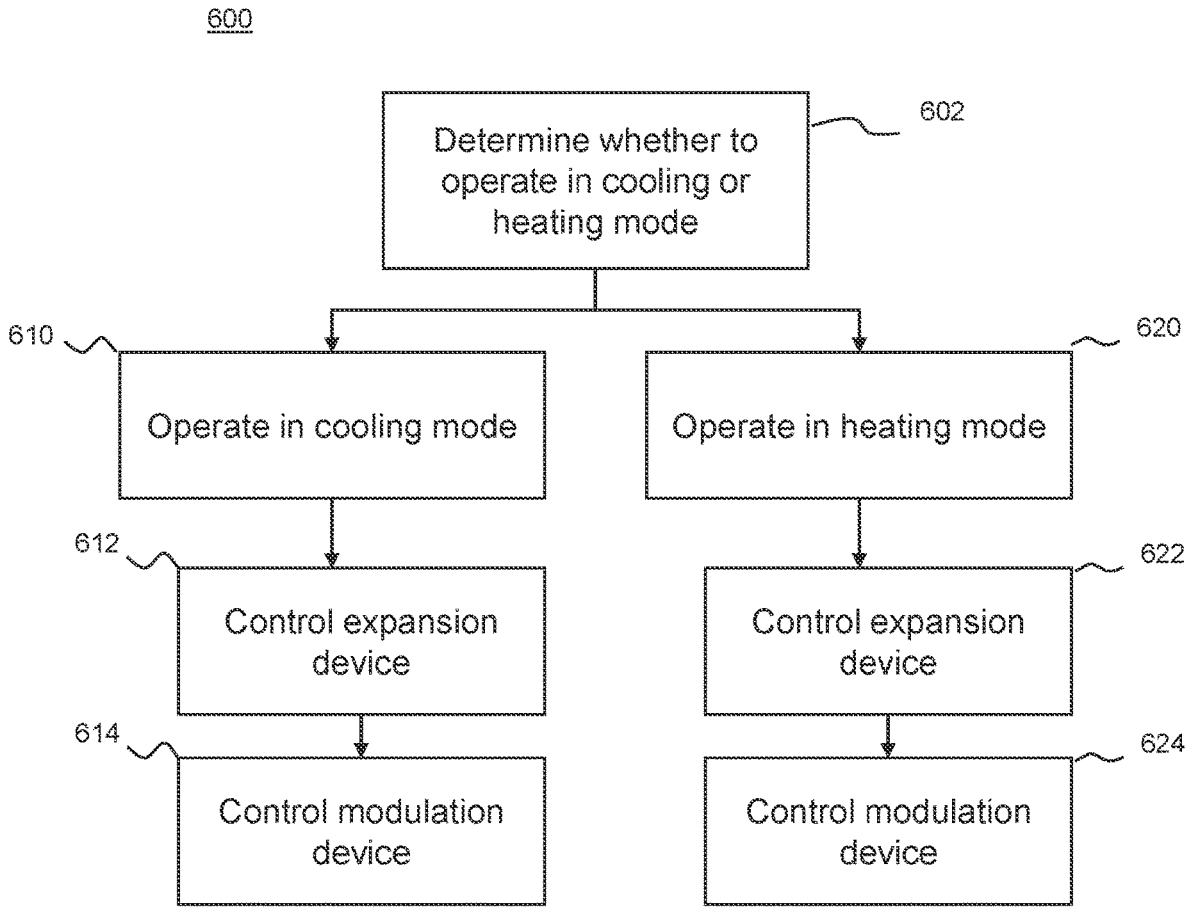
FIG. 6 is a flow chart of a method of operating a reversible heat pump system.

For completeness, FIG. 6 shows a flow chart of a method 600 of operating a reversible heat pump system, such as the reversible heat pump system 100 as described herein. The method will be described with reference to the example heat pump system 100 as described herein. Example methods have been described elsewhere herein and steps of the method are illustrated in FIG. 6. In block 602, it is determined (for example by the controller 120) whether to operate the reversible heat pump system in a cooling mode or a heating mode. The method has two branches corresponding to operation in the cooling mode (block 610), and operation in the heating mode (block 620). As will be appreciated, the method may comprise alternately operating in the respective modes dependent on the requirements of a load system, such as a chiller system as described herein.

In block 610, the heat pump system is operated in the cooling mode as described elsewhere herein. In particular, the controller may operate the system to target or maintain one or more thermodynamic conditions at one or more respective target locations. As described herein, the controller may evaluate various parameters (e.g. relating to monitored temperatures and pressures of the working fluid) to monitor thermodynamic conditions and determine how to adjust operation of the heat pump system. In particular, the controller may control the expansion device to maintain a thermodynamic condition (e.g. to maintain a superheat in working fluid provided to the compressor), as shown in block 612. Further, the controller may control the modulation device to maintain a thermodynamic condition (e.g. to maintain a temperature change in working fluid passing through a suction line economiser heat exchanger), as shown in block 614.

In block 620, the heat pump system is operated in the heating mode as described herein. In particular, the controller may operate the system to target or maintain one or more thermodynamic conditions at one or more respective target locations. The controller may control the expansion device to maintain a thermodynamic condition (e.g. to maintain a superheat in working fluid provided to the compressor), as shown in block 622. Further, the controller may control the modulation device to maintain a thermodynamic condition (e.g. to maintain a temperature change in working fluid passing through a suction line economiser heat exchanger), as shown in block 624.

The invention claimed is:

1. A method of operating a reversible heat pump system to control the temperature of a process fluid of a chiller system, the reversible heat pump system comprising:

a compressor, a first heat exchanger, an expansion device, a second heat exchanger for heat exchange with the process fluid of the chiller system, and a suction line economiser heat exchanger;

the method comprising:

a controller determining whether to operate the reversible heat pump system in a cooling mode to cool the process fluid, or in a heating mode to heat the process fluid;

when in the cooling mode, circulating a working fluid through the reversible heat pump system so that compressed working fluid from the compressor rejects heat at the first heat exchanger to provide condensed working fluid to a liquid line, and so that expanded working fluid from the expansion device receives heat from the process fluid at the second heat exchanger to provide superheated working fluid along a suction line to the compressor;

when in the heating mode, circulating the working fluid through the reversible heat pump system so that compressed working fluid from the compressor rejects heat to the process fluid at the second heat exchanger to provide condensed working fluid to the liquid line, and so that the expanded working fluid from the expansion device receives heat at the first heat exchanger to provide downstream superheated working fluid along the suction line to the compressor;

wherein the process fluid is provided to the second heat exchanger along a process fluid pathway from a process fluid inlet to a process fluid outlet, for heat exchange between the process fluid and the working fluid;

wherein a direction of working fluid flow through the second heat exchanger opposes the flow of process fluid along the process fluid pathway in the heating mode to provide a counterflow arrangement, such that in the heating mode an inlet for providing working fluid to the second heat exchanger is proximal to the process fluid outlet;

wherein a direction of working fluid flow through the second heat exchanger corresponds to the flow of process fluid along the process fluid pathway in the cooling mode to provide a co-current flow arrangement, such that in the cooling mode the inlet for providing working fluid to the second heat exchanger is proximal to the process fluid inlet;

wherein in each of the cooling mode and the heating mode, condensed working fluid upstream of the expansion device transfers heat to superheated working fluid upstream of the compressor, at the suction line economiser heat exchanger, further comprising controlling the expansion device to maintain a thermodynamic condition of the working fluid at a target location along the suction line;

and wherein:

the expansion device and a modulation device are controlled so that the working fluid is maintained at superheated conditions in the suction line, with a target superheat of at least a first superheat upstream of the suction line economiser heat exchanger, and with a target superheat of at least a second greater superheat downstream of the suction line economiser heat exchanger.

2. The method according to claim 1 further comprising monitoring one or more parameters relating to (i) a temperature of the working fluid at a location along the suction line and/or (ii) a pressure of the working fluid at a location along the suction line; and wherein the expansion device is controlled to maintain a target superheat of the working fluid at a target location along the suction line.

3. The method according to claim 1, further comprising controlling a modulation device disposed along the liquid line upstream of the expansion device, to maintain a target change of temperature of the expanded working fluid through the suction line economiser heat exchanger; and/or to maintain a target superheat of the working fluid at a target location along the suction line.

4. The method according to claim 3, further comprising monitoring temperature parameters relating to (i) a temperature of the working fluid in the suction line upstream of the suction line economiser heat exchanger and (ii) a temperature of the working fluid in the suction line downstream of the suction line economiser heat exchanger; and controlling the modulation device to maintain the target change of temperature based on the monitored temperature parameters.

5. The method according to claim 3, wherein the modulation device comprises a three-way valve in the liquid line for variably distributing a flow of condensed working fluid between a first liquid line branch to the suction line economiser heat exchanger and a second liquid line branch that bypasses the suction line economiser heat exchanger;

wherein controlling the modulation device comprises varying a distribution of the flow between the first and second liquid line branches.

6. A method of operating a reversible heat pump system to control the temperature of a process fluid of a chiller system, the reversible heat pump system comprising:

a compressor, a first heat exchanger, an expansion device, a second heat exchanger for heat exchange with the process fluid of the chiller system, and a suction line economiser heat exchanger;

the method comprising:

a controller determining whether to operate the reversible heat pump system in a cooling mode to cool the process fluid, or in a heating mode to heat the process fluid;

when in the cooling mode, circulating a working fluid through the reversible heat pump system so that compressed working fluid from the compressor rejects heat at the first heat exchanger to provide condensed working fluid to a liquid line, and so that expanded working fluid from the expansion device receives heat from the process fluid at the second heat exchanger to provide superheated working fluid along a suction line to the compressor;

when in the heating mode, circulating the working fluid through the reversible heat pump system so that compressed working fluid from the compressor rejects heat to the process fluid at the second heat exchanger to provide condensed working fluid to the liquid line, and so that the expanded working fluid from the expansion device receives heat at the first heat exchanger to provide downstream superheated working fluid along the suction line to the compressor;

wherein the process fluid is provided to the second heat exchanger along a process fluid pathway from a process fluid inlet to a process fluid outlet, for heat exchange between the process fluid and the working fluid;

wherein a direction of working fluid flow through the second heat exchanger opposes the flow of process fluid along the process fluid pathway in the heating mode to provide a counterflow arrangement, such that in the heating mode an inlet for providing working fluid to the second heat exchanger is proximal to the process fluid outlet;

wherein a direction of working fluid flow through the second heat exchanger corresponds to the flow of process fluid along the process fluid pathway in the cooling mode to provide a co-current flow arrangement, such that in the cooling mode the inlet for providing working fluid to the second heat exchanger is proximal to the process fluid inlet;

wherein in each of the cooling mode and the heating mode, condensed working fluid upstream of the expansion device transfers heat to superheated working fluid upstream of the compressor, at the suction line economiser heat exchanger, further comprising monitoring one or more parameters relating to (i) a temperature of the working fluid at a location along the suction line and/or (ii) a pressure of the working fluid at a location along the suction line;

wherein the expansion device is controlled to maintain a target superheat of the working fluid at a target location along the suction line;

wherein the method further comprises:

determining a saturation temperature parameter corresponding to a saturation temperature of the working fluid in the suction line;

wherein the control to maintain the target superheat is at least partly based on the saturation temperature parameter.

7. The method according to claim 6, wherein the saturation temperature parameter:

is determined by:

monitoring a pressure parameter relating to the pressure of the working fluid in the suction line; and evaluating a relationship between the pressure parameter and the saturation temperature parameter which is a function of the type of the working fluid.

8. A reversible heat pump system for heating and cooling a process fluid of a chiller system, comprising:

a compressor, a first heat exchanger, an expansion device, a second heat exchanger for heat exchange with the process fluid of the chiller system, and a suction line economiser heat exchanger;

wherein the reversible heat pump system is operable in:

a cooling configuration in which there is a sequential flow path for a working fluid through the reversible heat pump system from the compressor through the first heat exchanger, a liquid line pathway, the expansion device, the second heat exchanger and a suction line pathway to the compressor; and a heating configuration in which there is a sequential flow path for the working fluid from the compressor through the second heat exchanger, a liquid line, the expansion device, the first heat exchanger and a suction line pathway to the compressor;

wherein the second heat exchanger has a process fluid inlet, a process fluid outlet and a process fluid pathway therebetween for heat exchange between the process fluid provided from the chiller system and the working fluid provided to the second heat exchanger;

wherein the reversible heat pump system is configured so that working fluid is provided to the second heat exchanger along the respective sequential flow path:

along a flow direction which opposes flow of the process fluid along the process fluid pathway in the heating configuration in a counterflow arrangement, such that in the heating configuration an inlet for providing working fluid to the second heat exchanger is proximal to the process fluid outlet; and along a flow direction which corresponds to flow of the process fluid along the process fluid pathway in the cooling configuration in a co-current flow arrangement, such that in the cooling configuration an inlet for providing working fluid to the second heat exchanger is proximal to the process fluid inlet;

wherein in each of the cooling configuration and the heating configuration, the suction line economiser heat exchanger is configured to provide working fluid in the respective liquid line pathway in heat exchange communication with working fluid in the respective suction line pathway; and a controller configured to:

control the expansion device to maintain a target superheat of the working fluid at a target location along the suction line;

determine a saturation temperature parameter corresponding to a saturation temperature of the working fluid in the suction line; and wherein the control to maintain the target superheat is at least partly based on the saturation temperature parameter.

9. The reversible heat pump system of claim 8, wherein the reversible heat pump system is configured to control the expansion device to maintain a thermodynamic condition of the working fluid at a target location along the suction line.

10. The reversible heat pump system of claim 8, further comprising a modulation device disposed along the liquid line pathway upstream of the expansion device;

wherein the controller is configured to:

control the modulation device to maintain a target change of temperature of the working fluid through the suction line economiser heat exchanger.

* * * * *